US006581611B2

(12) United States Patent
Sartena

(10) Patent No.: US 6,581,611 B2
(45) Date of Patent: Jun. 24, 2003

(54) HAIR FASHION ACCESSORY

(75) Inventor: Staccy Eve Sartena, Great Neck, NY (US)

(73) Assignee: Hair Blast, Inc., Smithtown, NY (US)

( * ) Notice: Subject to any disclaimer, the term of this patent is extended or adjusted under 35 U.S.C. 154(b) by 0 days.

(21) Appl. No.: 10/060,474

(22) Filed: Jan. 30, 2002

(65) Prior Publication Data

US 2003/0015213 A1 Jan. 23, 2003

Related U.S. Application Data

(62) Division of application No. 09/911,168, filed on Jul. 23, 2001.

(51) Int. Cl.[7] ..... A45D 8/12
(52) U.S. Cl. ..... 132/275; 132/277
(58) Field of Search ..... 132/275, 277, 132/61, 60, 57.1, 135, 138, 53; D28/39, 40, 41, 42; 63/13, 14.5, 21, 23

(56) References Cited

U.S. PATENT DOCUMENTS

| | | | | | |
|---|---|---|---|---|---|
| D187,527 | S | * | 3/1960 | Greene | D17/3 |
| 3,533,247 | A | | 10/1970 | Douglas | |
| D246,293 | S | | 11/1977 | Doughty | |
| 4,510,654 | A | * | 4/1985 | Muller | 24/344 |
| 4,745,661 | A | * | 5/1988 | Wainscott | 24/3 M |
| 4,879,882 | A | * | 11/1989 | Johnson et al. | 63/4 |
| 5,097,569 | A | * | 3/1992 | Erickson | 24/49 R |
| 5,441,061 | A | * | 8/1995 | Jordan et al. | 132/275 |
| 5,501,239 | A | * | 3/1996 | Walker | 132/275 |
| 5,549,127 | A | | 8/1996 | Chang | |
| D384,786 | S | | 10/1997 | LaFauci | |
| 6,260,559 | B1 | * | 7/2001 | Schirren et al. | 132/275 |
| 6,305,386 | B1 | | 10/2001 | Wochadlo | |
| 6,314,969 | B1 | | 11/2001 | Lacause | |

* cited by examiner

*Primary Examiner*—Todd E. Manahan
(74) *Attorney, Agent, or Firm*—Schweitzer Cornman Gross & Bondell LLP

(57) ABSTRACT

A fashion hair accessory comprises a claw-type hair clip formed of hinged-together clip elements with interleaved tines, combined in a novel manner with purely decorative article of elongated, flexible character. To particular advantage, the claw clip is provided with decorative openings in its body portion, and a decorative article, such as a flexible chain, is secured through the decorative opening of the clip body and dangles freely and flexibly from the clip.

4 Claims, 12 Drawing Sheets

HAIR FASHION ACCESSORY

RELATED APPLICATIONS

This application is a division of my earlier application Ser. No. 09/911,168, filed Jul. 23, 2001.

BACKGROUND OF THE INVENTION

Claw clips, which are comprised of a pair of hinged-together clip elements with interleaved tines, are well known accessories useful in a variety of ways in connection with the management of women's hair. In addition, claw clips lend themselves to combining with other elements, as fashion accessories.

SUMMARY OF THE INVENTION

The present invention is directed to a new and improved form of fashion accessory, comprising a claw-type hair clip and attached, elongated flexible pendant element suspended from the clip and providing an attractive fashion accessory in the nature of hair jewelry.

To particular advantage, the claw clip is provided in its body portion with openings adjacent each end of the clip (a feature in itself well known) and one such opening is utilized for attachment of the elongated, flexible pendant element. In cases where the elongated flexible pendant element is in the nature of a continuous material, such as a leather thong, for example, the element may be simply looped through the clip opening, and tied or secured by a cinch, for example. Where the elongated pendant element is in the nature of a metallic or plastic chain or the like, it may be attached at the opening by means of a securing ring.

As will be apparent upon review of the following specification and drawings, the invention lends itself to a wide variety of choices of materials and structures for the elongated flexible pendant elements.

For a more complete understanding of the above and other features and advantages of the invention, reference should be made to the following detailed description of preferred embodiments of the invention, and to the accompanying drawings.

DESCRIPTION OF PREFERRED EMBODIMENTS

Figures 1, 3:
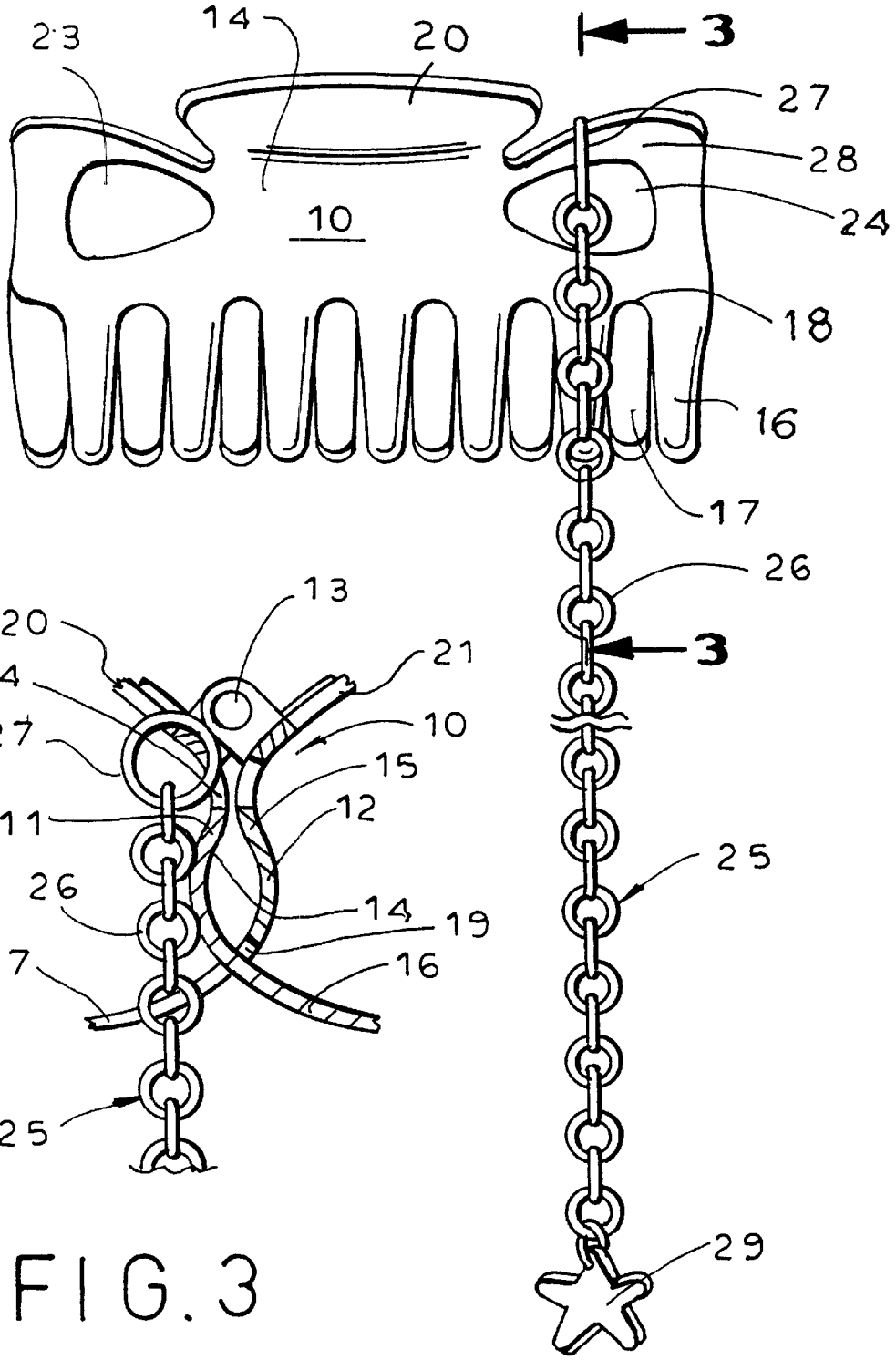
FIG. 1 is a front elevational view of a first preferred embodiment of the invention.
FIG. 3 is a fragmentary cross sectional view as taken generally on line 3—3 of FIG. 1.
Figure 2:
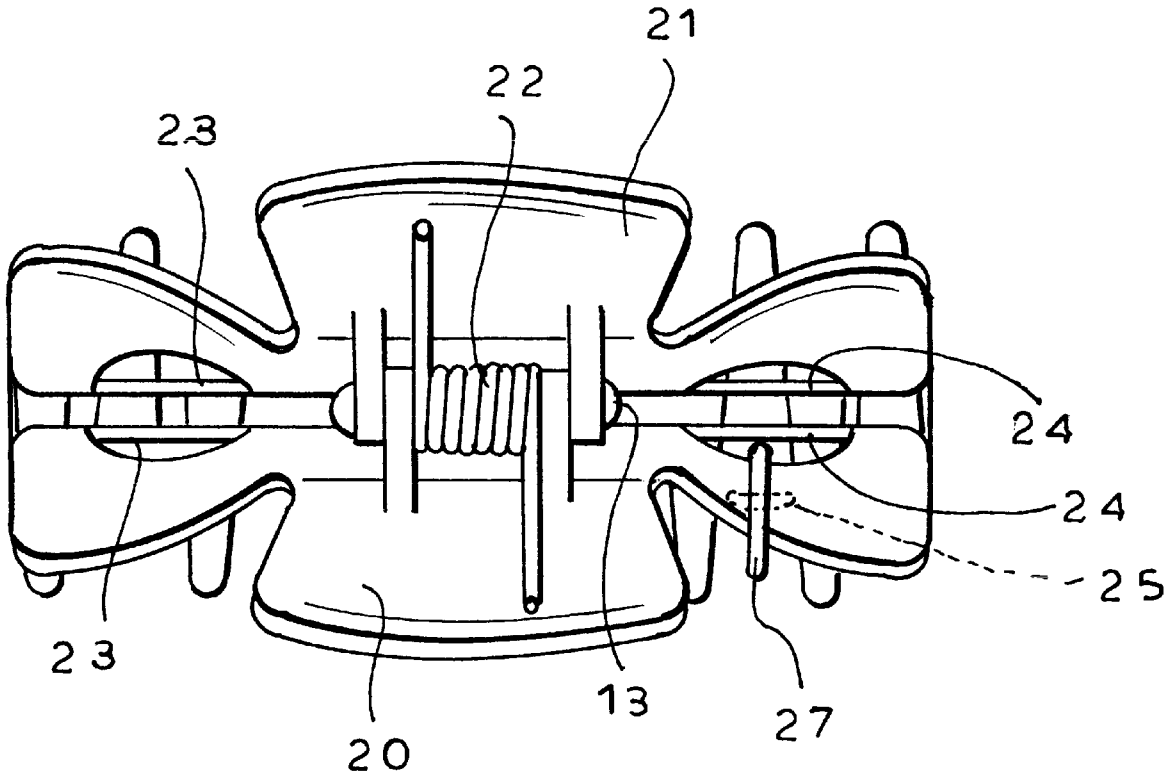
FIG. 2 is a top plan view of the device of FIG. 1.

Referring now to the drawing, and initially to FIGS. 1–3, the reference numeral 10 designates generally a claw clip device comprised of first and second clip elements 11, 12 pivotally joined by a hinge pin 13. Each of the clip elements has a body portion 14, 15 from which extend a plurality of arcuately contoured tines 16, 17. The tines of one clip element are received in spaces 18, 19 formed between the respective tines 16, 17.

On the side thereof opposite the tines 16, 17 (i.e., the top as shown in FIGS. 1 and 3), the clip elements are provided with gripping handles 20, 21 which can be gripped in order to pivot the respective clip elements 11, 12 to "open" positions. A coil spring 22 (FIG. 2) normally urges the clip to a "closed" position, shown in FIGS. 1–3, in which the tines of one clip element are seated deeply in the spaces 19 of the opposite clip element.

In a preferred form of the invention, the clip elements 11, 12 are provided at each end with openings 23, 24.

The clip as thus far described is, in itself, well known as, for example, represented by the Chang U.S. Pat. No. 5,549,127.

In the embodiment of FIGS. 1–3, a flexible pendant decorative element 25 is provided, in the form a jewelry chain comprised interconnected small links 26. At its upper end, the chain 25 is connected to the claw clip by means of a connecting ring 27 which passes through one of the openings 24 and around a portion 28 of the clip which lies above the opening 24 in the orientation illustrated in FIG. 1. The chain 25 may be provided at any point along its length with one or more decorative objects 29.

The flexible, pendant chain 25 hangs freely down from the clip 10, in any orientation in which the clip is worn in the user's hair, as will be readily understood.

Figure 4:
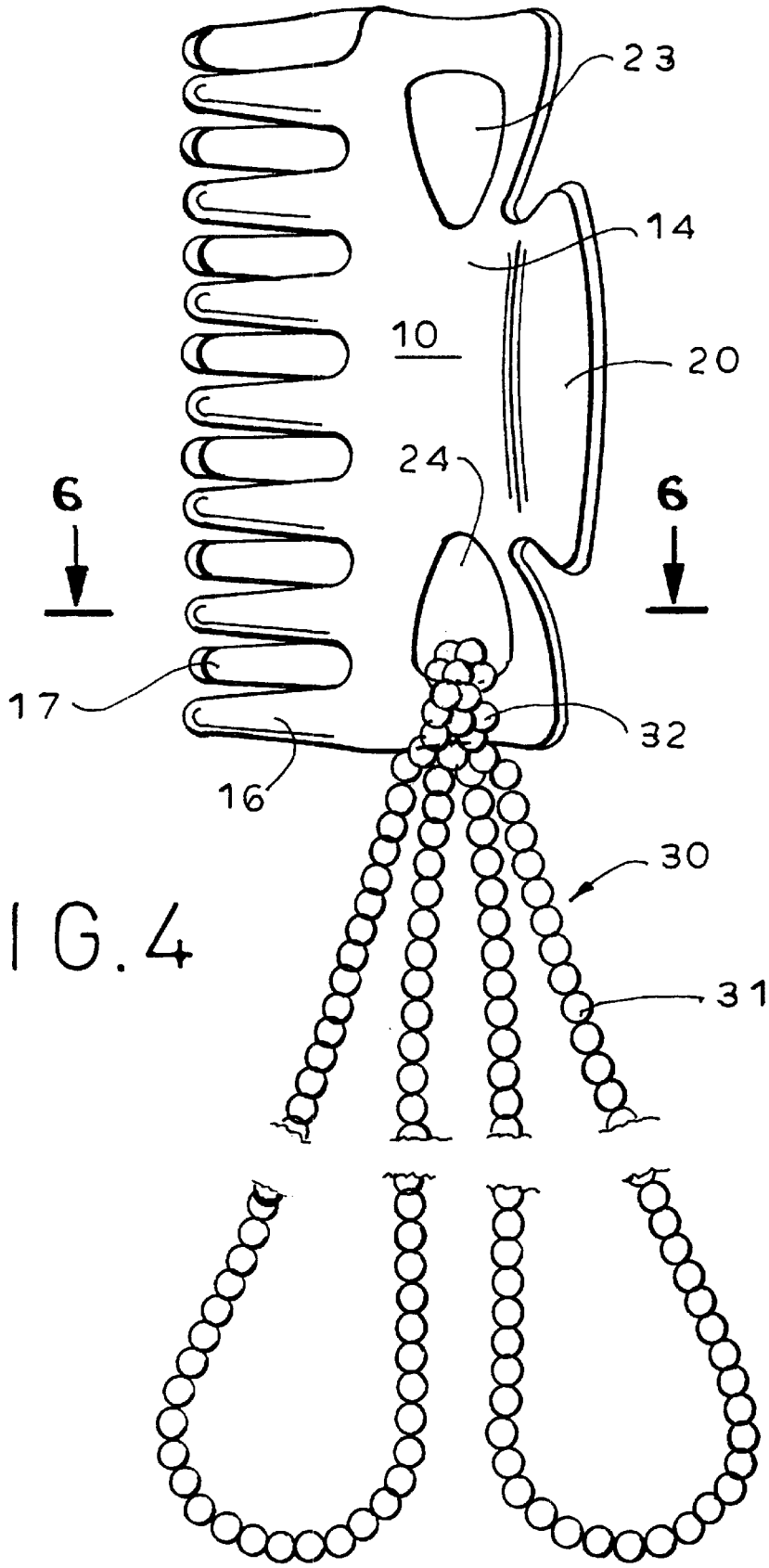
FIG. 4 is an elevational view of a second preferred embodiment of the invention.
Figure 5:
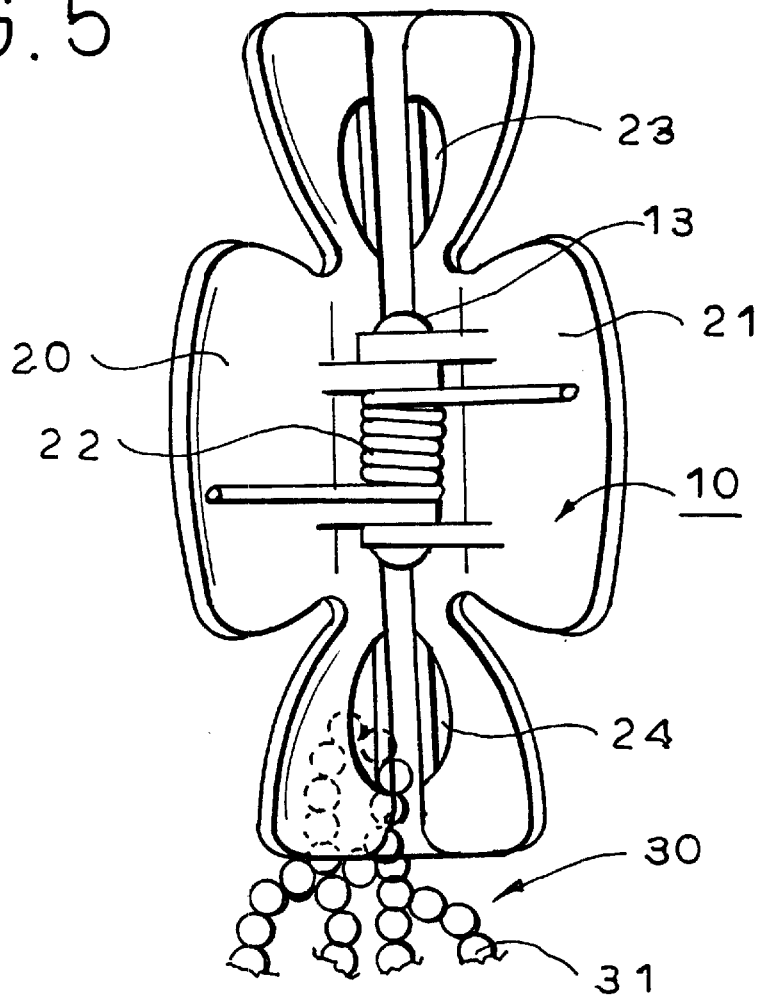
FIG. 5 is a side elevational view of the device of FIG. 4.
Figure 6:
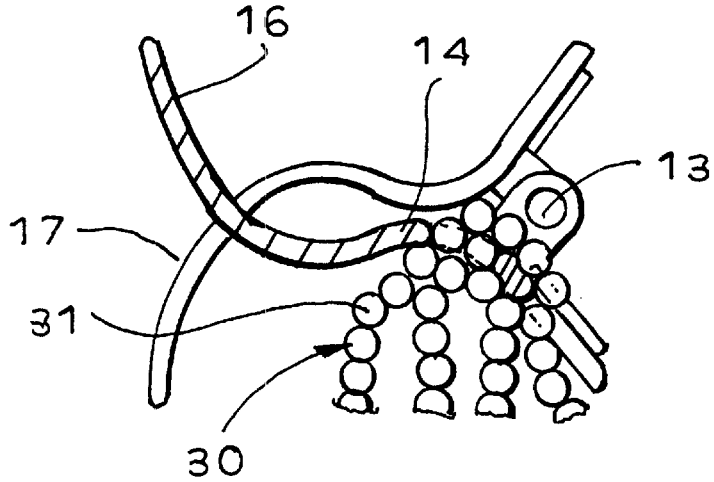
FIG. 6 is a fragmentary cross sectional view as taken generally along line 6—6 of FIG. 4.
Figures 7, 10:
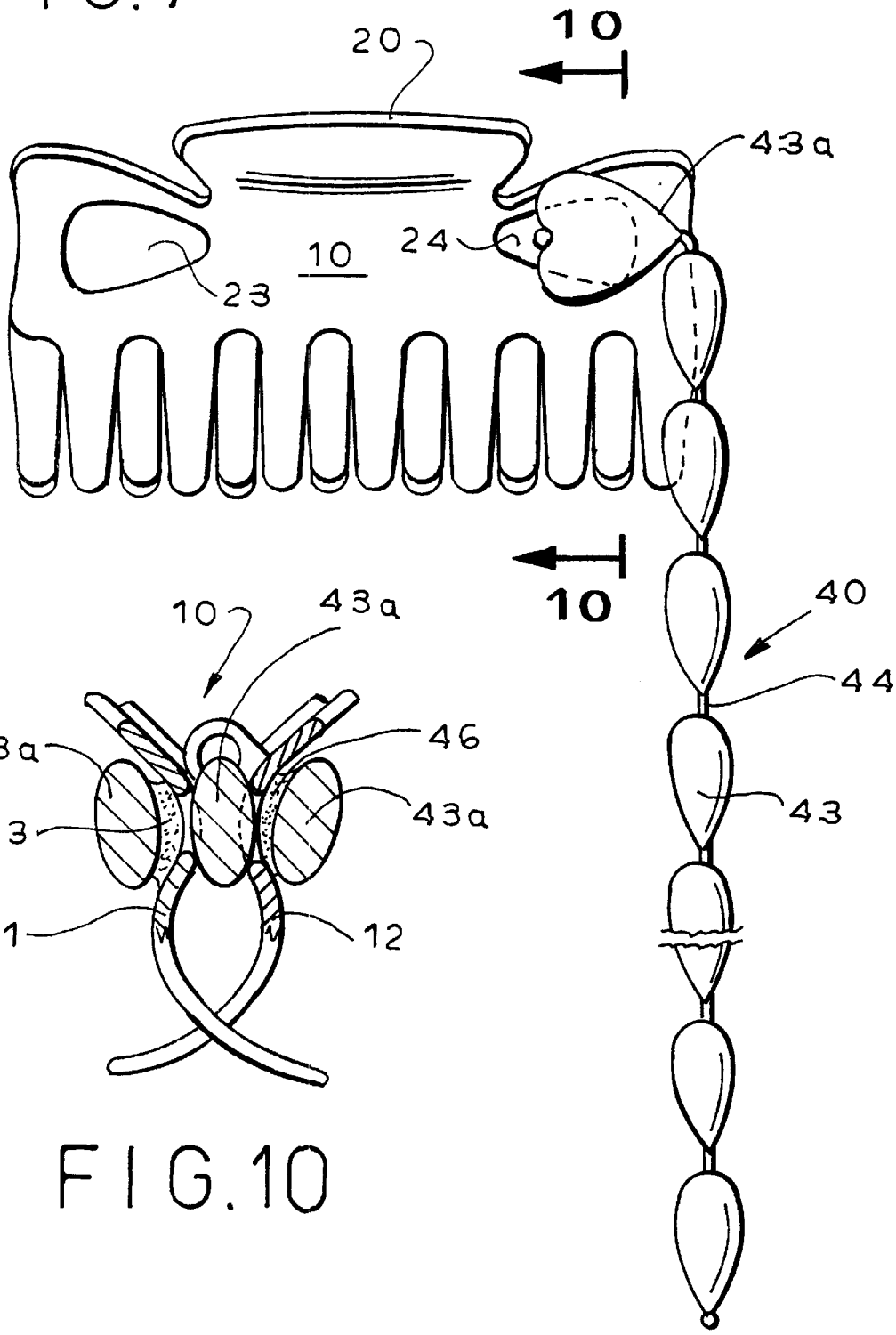
FIG. 7 is an elevational view of a third preferred embodiment of the invention.
FIG. 10 is a fragmentary cross sectional view as taken generally on line 10—10 of FIG. 7.
Figure 8:
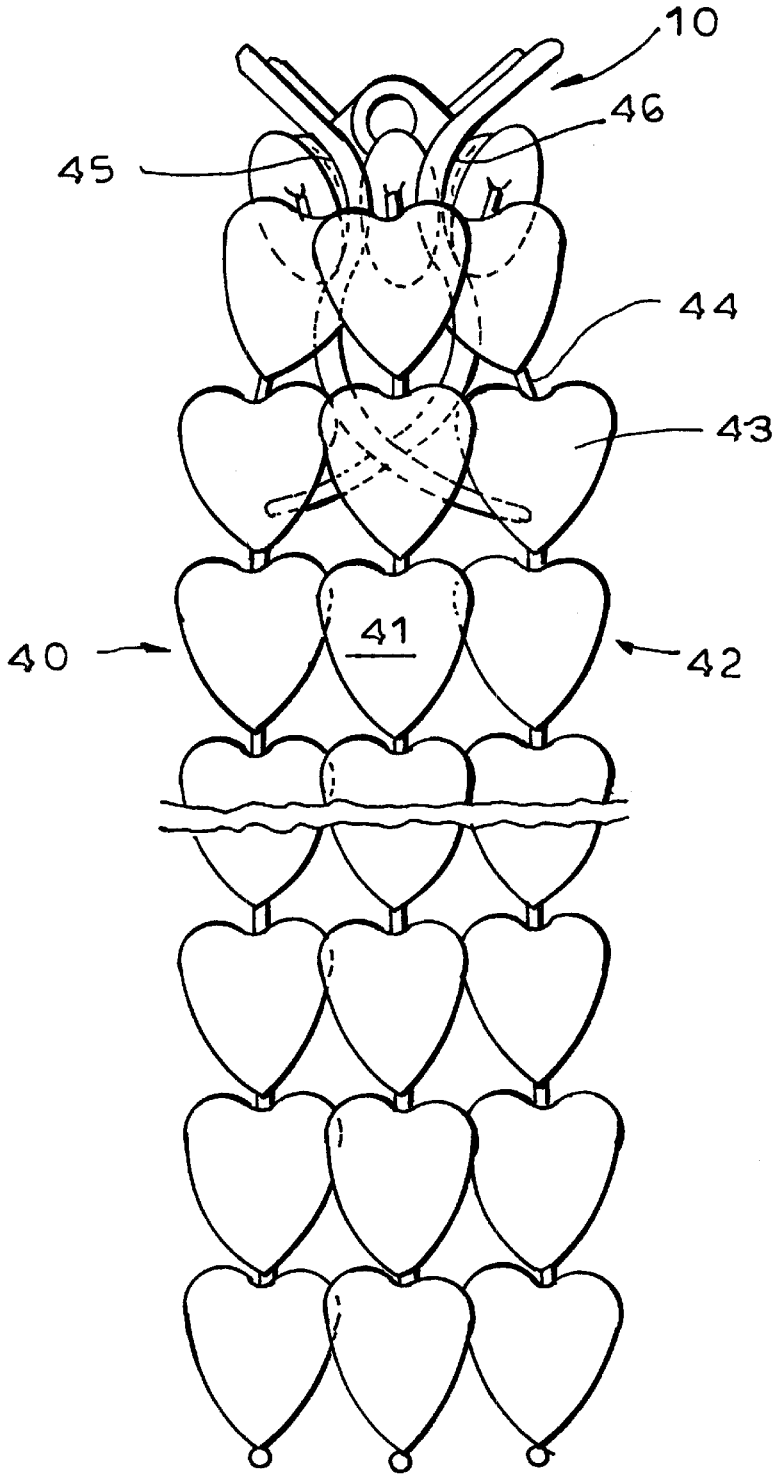
FIG. 8 is an end elevational view of the device of FIG. 7.
Figure 9:
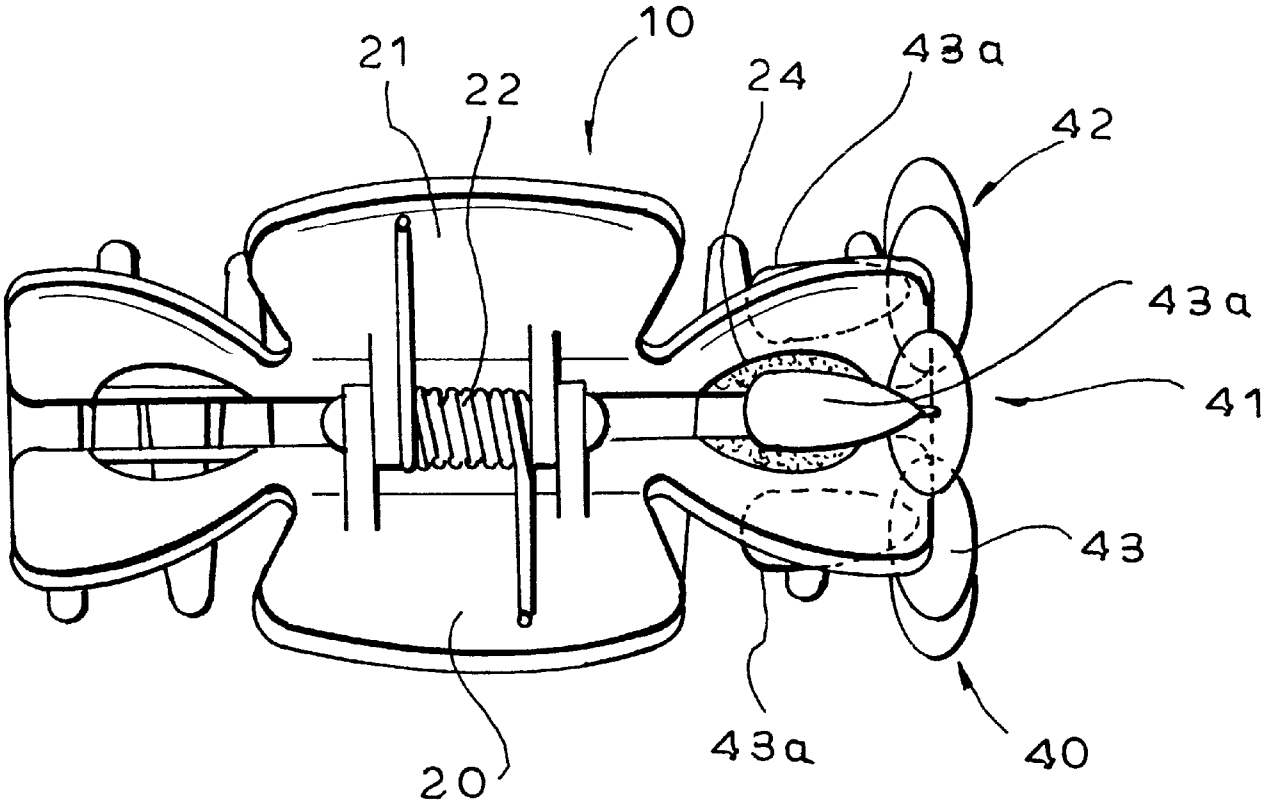
FIG. 9 is a plan view of the device of FIG. 7.

In the embodiment of FIGS. 4–6, a clip 10, which may correspond to the clip shown in FIGS. 1–3, is provided with an elongated, flexible pendant in the form of a string 30 of small beads 31 on a string (not shown). In the illustrated arrangement, the string of beads is in the form of a continuous loop, and is secured to the clip 10 by being passed through the opening 24 in the clip body and secured by tying the beads in a knot 32. Typically, the length of the bead string is substantial in relation to the length mentioned of the clip 10, so that the string hangs downward eight or ten inches or so from the clip, allowing the pendant element to swing freely when the clip is secured to a user's hair.

Referring now to the embodiment of FIGS. 7–10, there is shown a further preferred form of the invention which is comprised a claw clip 10, which can be generally of the type shown and described in FIGS. 1–3. In the illustration of FIGS. 7–10, the elongated, flexible pendant element is comprised of a plurality of strings 40, 41, 42 of beads 43. In the illustration, there are three such strings, each comprising a series of beads of appropriate shape, color and design, flexibly joined by strings 44. In the illustrated arrangement, the three strings of beads are secured to the clip 10, preferably adjacent one end thereof, by adhesive means 45, 46 securing one of the beads of each string, typically the uppermost bead 43*a* thereof, to the body of the clip. When using adhesive to secure the uppermost bead to the clip body, it is not necessary that the clip body be provided with the openings 23, 24, although it is not precluded. In the specific embodiment of FIGS. 7–10, two of the strings are mounted by securing their uppermost beads 43*a* to outside surface areas of the clip 10. A third string is mounted by securing its uppermost bead 43*a* between the two elements 11, 12 of the clip. Where the clip is provided with an opening 24, as illustrated in FIGS. 7–10, two of the beads may be at least partially secured by adhesive 46 passing through the opening 24. On the opposite side, the adhesive 45 is preferably confined to the exterior surfaces of the clip element 11.

As in the other embodiments, the flexible, pendant bead strings 40–42 may be as long as desired, typically having a free hanging length several times the length of the clip itself.

Figure 11:
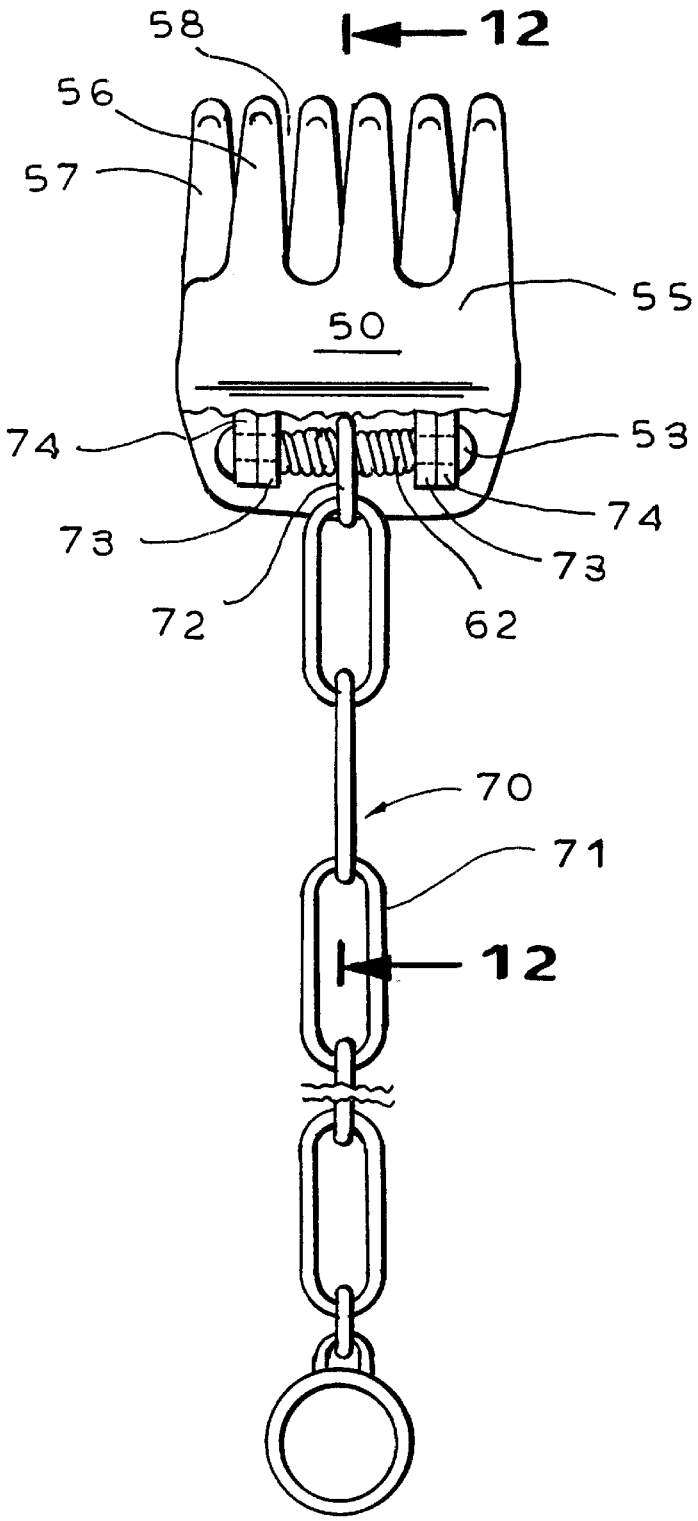
FIG. 11 is a side elevational view of a fourth preferred embodiment of the invention.
Figure 12:
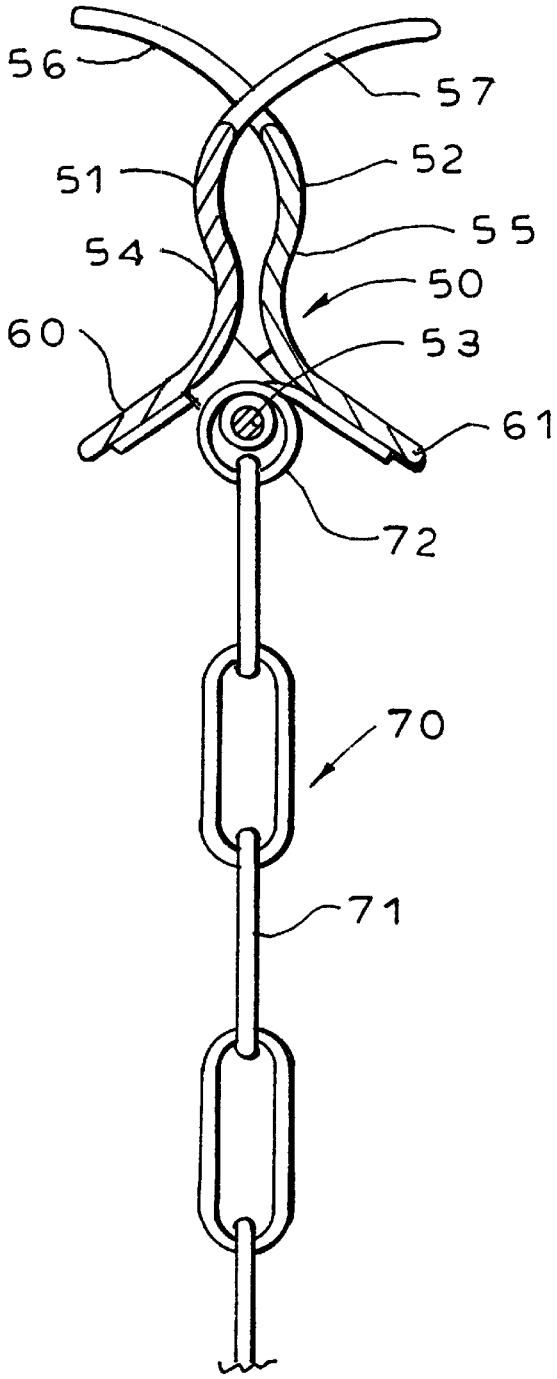
FIG. 12 is a fragmentary cross sectional view as taken generally on line 12—12 of FIG. 11.
Figure 13:
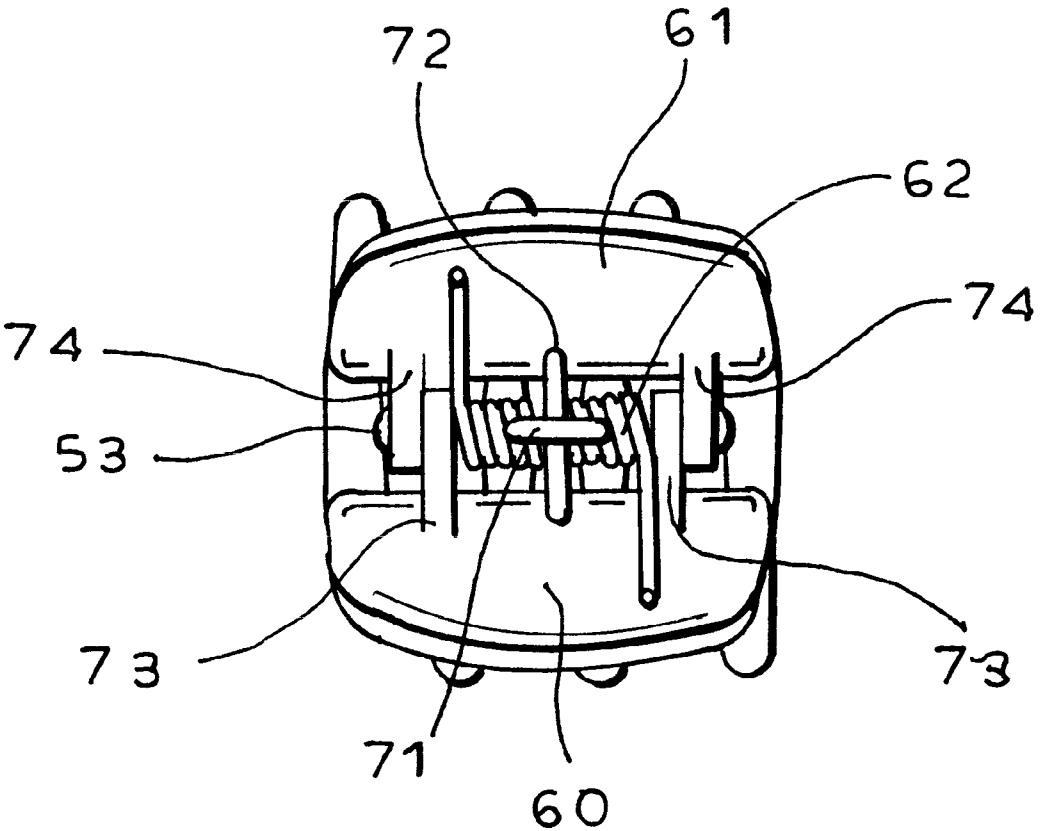
FIG. 13 is a top plan view of the device of FIG. 11.

Referring now to FIGS. 11–13, there is shown a further modified form of clip and flexible pendant element. The clip 50 is a claw clip of the same general type as the clip 10, although having a different configuration. The clip 50 comprises first and second clip elements 51, 52 joined by a pivot pin 53 for pivoting movement. Each of the clip elements has a body portion 54, 55 from which extend a plurality of arcuately contoured tines 56, 57. The tines 57 of one clip element are received in spaces 58 defined between tines 56 of the other clip element. Gripping handles 60, 61 extend from the body portions 54, 55, in a direction opposite from the tines and enable the clip to be gripped for opening and closing. A coil spring 62 is received over the pivot pin 53 and engages each of the gripping elements 60, 61 to urge the respective clip elements 51, 52 toward a "closed" position, as shown in FIG. 12.

In the embodiment of FIGS. 11–13, an elongated, flexible pendant chain element 70, comprised of elongated chain links 71, is connected to the clip 50 by means of a connecting ring 72 which surrounds the pivot pin 53 and coil spring 62 and is confined in that location by means of pivot arms 73, 74 which extend from the gripping elements 60, 61 respectively and engage the opposite ends of the pivot pin 53, as reflected in FIGS. 11 and 13.

Figure 14:
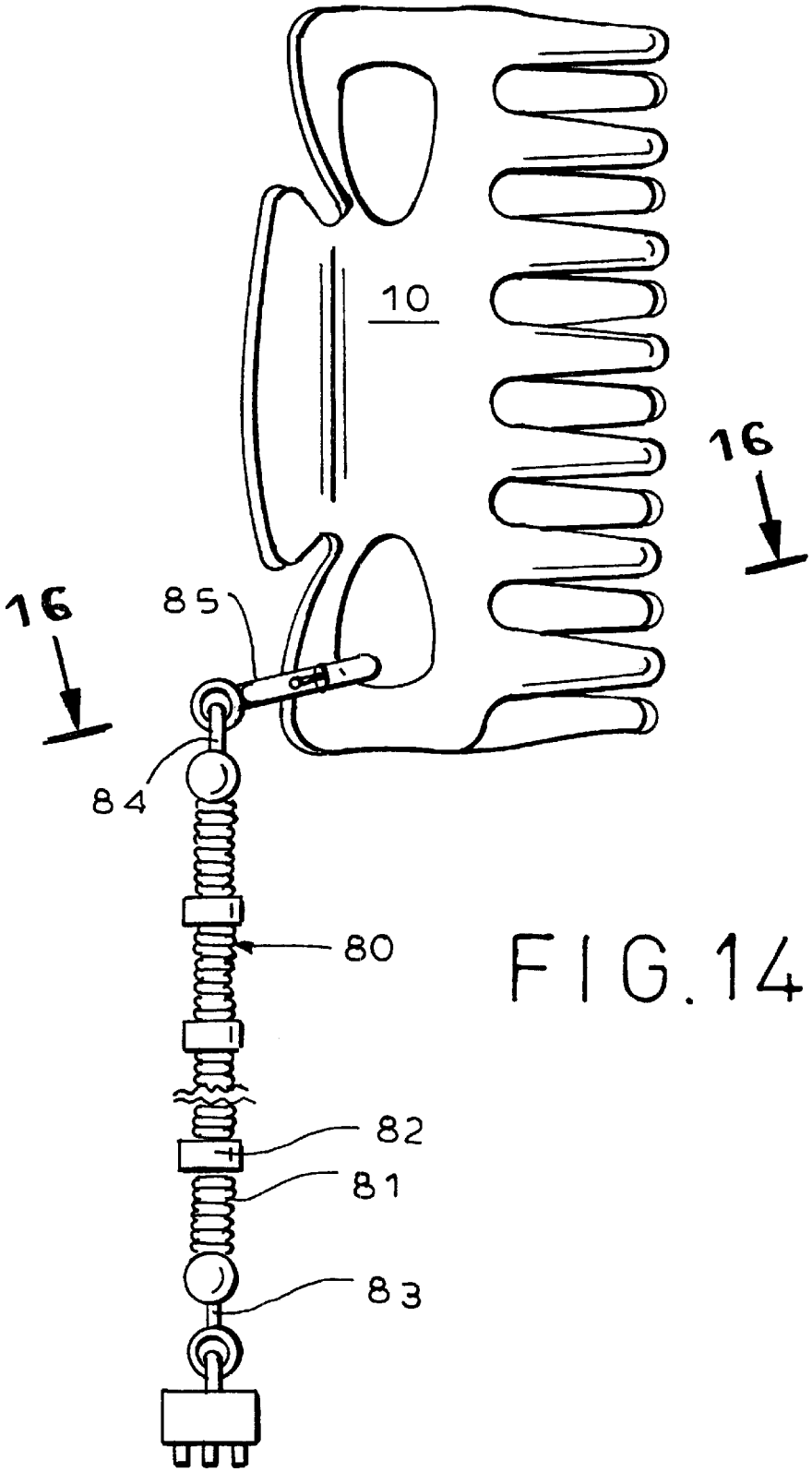
FIG. 14 is an elevational view of a fifth preferred embodiment of the invention.
Figure 15:
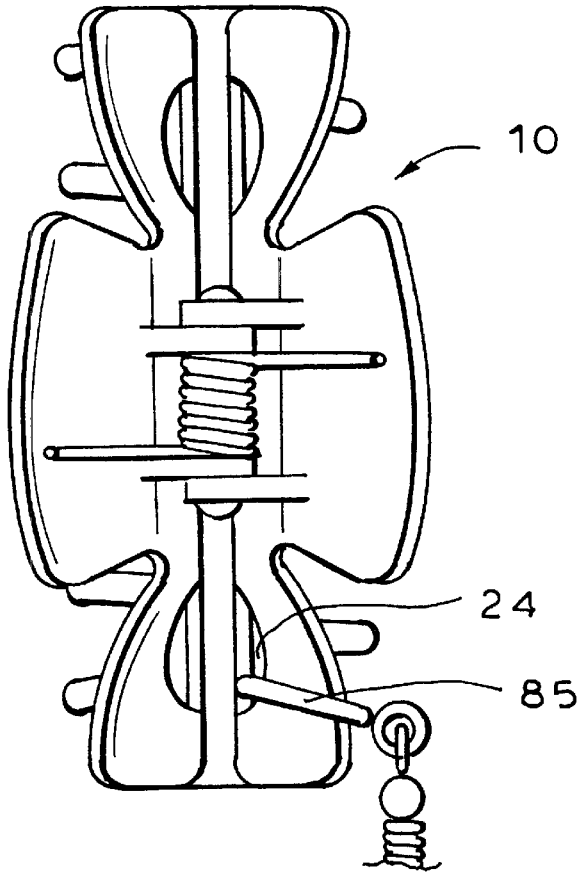
FIG. 15 is a end elevational view of the device of FIG. 14.
Figure 16:
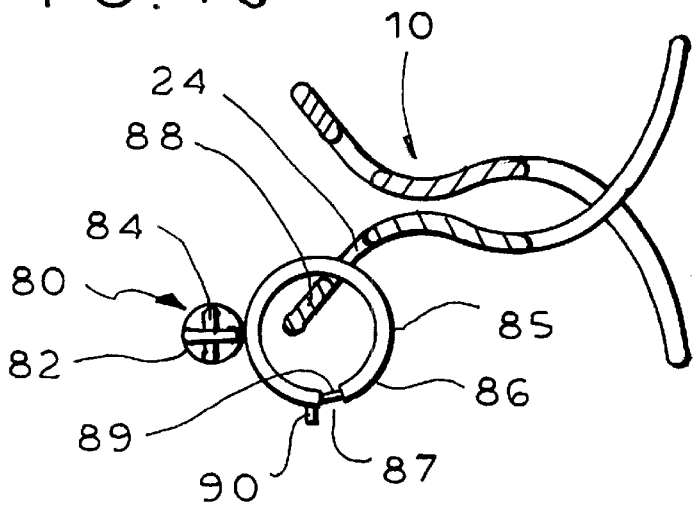
FIG. 16 is a fragmentary cross sectional view as taken generally on line 16—16 of FIG. 14.

In the embodiment of FIGS. 14–16, a claw clip 10 is illustrated, which is generally in the form of the clip shown in FIGS. 1–4, for illustrative purposes. In this embodiment, an elongated flexible pendant 80, illustrated to be in the nature of small beads 81, 82 mounted on a flexible string 83 or the like, it being understood that (in this as well as all other embodiments) the specific form of pendant is illustrative, and that an endless variety of pendants may be employed. For securing the pendant decoration 80 to the clip 10, the upper end 84 of the pendant is connected to a spring operated latch ring 85. The latch ring 85 is per se of well known design. It has a body 86 of circular configuration formed with a gap 87 of predetermined width. In this instance, the gap 87 is of sufficient width to receive the thickness dimension of upper portions 88 of the clip 10, in the region of the opening 24 provided therein, as shown in FIG. 16. The gap 87 is normally closed by a spring operated slide pin 89 which is engageable for retraction by a projection 90 and is returned to the closed position, illustrated in FIG. 16, by means of an internal spring (not shown).

The pendant decoration 80 is mounted on the clip 10 by opening the latch ring 85 and sliding in the gap 87 over the portion 84 of the clip until the ring is received within the opening 24. The latch pin 89 is then released and allowed to return to a closed position as shown in FIG. 16. The decoration 80 may be removed and replaced by other decorative pendants, or multiple pendant elements may be employed, to suit the choice and convenience of the user. Within the contemplation of the invention, almost any elongated, flexible pendant element may be utilized in conjunction with a claw-type hair clip, to achieve a novel, attractive and useful hair fashion accessory. Most versatile, perhaps, are claw clips provided with openings in the body portions thereof. This enables an extremely wide variety of flexible elements to be used as pendant decorations, such as strings of beads, leather thongs, braids of hair, etc. In many instances, soft flexible elements can simply be inserted through the clip openings and tied in a knot or cinched by a collar. In other cases, connecting rings of suitable size can be used to join the pendant decorative element to the clip, by passing the connecting element through the opening in the clip body. The connecting ring can be permanently closed or may be in the nature of a latch ring, which can be repetitively opened and closed for interchanging of decorative elements according to the variable wishes of the user.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A hair fashion accessory which comprises (a) a claw clip adapted for attachment to the hair of a user, (b) said claw clip having a pair of elongated claw clip elements connected for pivoting movement about a hinge axis and each having a plurality of tines spaced apart in a direction of said axis positioned to be received in spaces between tines of the other claw clip element, (c) each of said claw clip elements being formed with openings in a body portion thereof, adjacent each end of said body portion, and (d) a decorative article movably attached to said clip element, (e) said decorative article comprising an elongated flexible pendant element connected to said clip element and extending freely and flexibly therefrom, (f) said elongated flexible pendant element being connected to one of said claw clip elements by means of a connecting ring passing through one of said openings thereof, (g) said connecting ring is a latch ring formed with a gap and having a spring retractable locking pin for closing said gap.

2. A hair fashion accessory according to claim 1, wherein (a) said elongated flexible pendant element comprises a chain.

3. A hair fashion accessory which comprises (a) a claw clip adapted for attachment to the hair of a user, (b) said claw clip having a pair of elongated claw clip elements connected for pivoting movement about a hinge axis and each having a plurality of tines spaced apart in a direction of said axis positioned to be received in spaces between tines of the other claw clip element, (c) each of said claw clip elements being formed with openings in a body portion thereof, adjacent each end of said body portion, and (d) a decorative article movably attached to said clip element, (e) said decorative article comprising an elongated flexible pendant element connected to said clip element and extending freely and flexibly therefrom, (f) said elongated flexible pendant element being connected to one of said claw clip elements by being passed through one of said openings thereof, (g) said elongated flexible pendant element having first and second parts, wherein one of said parts is passed through one of said openings and secured to the other of said parts, (h) said first and second parts are secured by being knotted together.

4. A hair fashion accessory according to claim 3, wherein (a) said elongated flexible pendant element comprises one or more strings of beads.

* * * * *